US008568166B2

(12) United States Patent
Ryu et al.

(10) Patent No.: US 8,568,166 B2
(45) Date of Patent: Oct. 29, 2013

(54) HIGH-VOLTAGE COAXIAL CABLE AND CONNECTOR

(75) Inventors: Seung-Kab Ryu, Daejeon (KR); Kyung-Hoon Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 34 days.

(21) Appl. No.: 13/330,757

(22) Filed: Dec. 20, 2011

(65) Prior Publication Data

US 2012/0289083 A1 Nov. 15, 2012

(30) Foreign Application Priority Data

May 12, 2011 (KR) ..... 10-2011-0044759

(51) Int. Cl.
*H01R 9/05* (2006.01)

(52) U.S. Cl.
USPC ..... 439/578; 439/585

(58) Field of Classification Search
USPC ..... 439/578, 583–585, 606, 660
See application file for complete search history.

(56) References Cited

U.S. PATENT DOCUMENTS 2,870,420 A * 1/1959 Malek ..... 333/33
3,854,789 A * 12/1974 Kaplan ..... 439/584
5,052,946 A 10/1991 Homolka
5,232,377 A * 8/1993 Leibfried, Jr. ..... 439/320
5,651,698 A * 7/1997 Locati et al. ..... 439/578
6,102,738 A * 8/2000 Macek et al. ..... 439/584
6,447,323 B1 * 9/2002 Watanabe ..... 439/371
6,884,115 B2 * 4/2005 Malloy ..... 439/584
8,221,161 B2 * 7/2012 Leibfried, Jr. ..... 439/578
2003/0092289 A1 5/2003 Otsu

FOREIGN PATENT DOCUMENTS

KR 20-0297051 Y1 11/2002
KR 10-2003-0038505 A 5/2003
KR 10-2009-0076499 A 7/2009

* cited by examiner

*Primary Examiner* — Thanh Tam Le
(74) *Attorney, Agent, or Firm* — LRK Patent Law Firm

(57) ABSTRACT

A high-voltage coaxial cable and a connector are provided. The connector includes inner connector electrode, a connector dielectric enclosing an inner connector electrode, and an external connector housing. The inside electrode of a connector is provided with a tapped hole in one side thereof. The tapped hole corresponds to the threaded single core of a high-voltage coaxial cable. The inside electrode of a connector is selectively assembled with and separated from the high-voltage coaxial cable by selectively screwing the threaded single core into and away from the tapped hole. The connector dielectric is formed along the circumferential surface of the inside electrode, and is provided with a coupling portion. The coupling portion couples the connector with another connector, and is formed to a preset depth in a corrugated shape. The connector housing is formed in a shape that surrounds the connector dielectric.

6 Claims, 7 Drawing Sheets

HIGH-VOLTAGE COAXIAL CABLE AND CONNECTOR

CROSS REFERENCE TO RELATED APPLICATION

This application claims the benefit of Korean Patent Application No. 10-2011-0044759, filed on May 12, 2011, which is hereby incorporated by reference in its entirety into this application.

BACKGROUND OF THE INVENTION

1. Technical Field

The present invention relates generally to a high-voltage coaxial cable and a connector and, more particularly, to a high-voltage coaxial cable and a connector which are capable of, in a high-voltage environment, ensuring flexibility for the wiring of the coaxial cable and the placement of the connector and providing the stability of electrical contact when the coaxial cable is repeatedly assembled with and separated from the connector.

2. Description of the Related Art

A high-voltage coaxial cable is comprised of a central core, an insulating and impedance-matching dielectric substance and additional conductor for shielding and grounding, and is used to transmit high-voltage pulse signals without any dielectric breakdown.

A conventional coaxial cable and connector have a problem in that it is difficult to separate and couple the cable from and with the connector because insulating glue is applied onto the coupled portion of the inside electrode of the connector and the coupled portion of the core of the coaxial cable.

Furthermore, the conventional coaxial cable and connector designed for dielectric substance with circularly terraced cutting for insulation performance have a problem in that it is difficult to replace the connector or the cable individually even when dielectric breakdown occurs in one of the connector and the cable.

Furthermore, the conventional coaxial cable and connector have problems in that insulation performance, which is deteriorated due to the bending characteristic of the coaxial cable in terms of high-voltage characteristics and spatial limitation is imposed on the wiring of the coaxial cable and the placement of the connector.

SUMMARY OF THE INVENTION

Accordingly, the present invention has been made keeping in mind the above problems occurring in the prior art, and an object of the present invention is to provide a high-voltage coaxial cable and a connector, which provide an insulating structure in the direction of the contact surface between connectors so that flexibility can be ensured for the wiring of the high-voltage coaxial cable and the placement of the connector, and which are configured to allow the core of the high-voltage coaxial cable to be coupled with the inside electrode of the connector in a threaded manner so that the property of coupling and the performance of electrical contact can be prevented from being deteriorated even when the core of the high-voltage coaxial cable is repeatedly assembled with and separated from the inside electrode of the connector.

In order to accomplish the above object, the present invention provides a connector, including inside electrode of a connector provided with a tapped hole in one side thereof, the tapped hole corresponding to a threaded single core of a high-voltage coaxial cable, inside electrode of the connector being selectively assembled with and separated from the high-voltage coaxial cable by selectively screwing the threaded single core into and away from the tapped hole; a connector dielectric formed along a circumferential surface of the inside electrode of a connector, and provided with an coupling portion, the coupling portion being adapted to couple the connector with another connector and being formed to a preset depth in a corrugated shape; and a connector housing formed in a shape that surrounds the connector dielectric.

The inside electrode of a connector may be provided with slits in a remaining side thereof, the slits being arranged at locations which correspond to four ends of a cross or two ends of a section of a line.

The connector dielectric may be an insulator which is made of plastic resin.

A diameter of the connector dielectric may increase linearly as a diameter of the inside electrode increases.

The coupling portion may be formed in a corrugated shape, and may be adapted to couple the connector with the other connector.

The coupling portion may be formed in a projected, corrugated shape, and may be adapted to couple the connector with the other connector.

The connector housing may include a connector attachment member formed in a ring shape and adapted to support the connector dielectric; a connector ground metal member coupled to the connector attachment member and adapted to surround a surface of one side of the connector dielectric; a connector auxiliary coupling member coupled to the connector ground metal member, and adapted to provide electrical contact and surround a surface of a remaining side of the connector dielectric; and a connector fastening member coupled to the connector auxiliary coupling member, and adapted to surround and fasten the high-voltage coaxial cable.

In order to accomplish the above object, the present invention provides a high-voltage coaxial cable, including a single core; a cable dielectric formed along a circumferential surface of the single core; a cable outside conductor formed along a circumferential surface of the cable dielectric; and a jacket formed along a circumferential surface of the cable outside conductor; wherein the single core is provided with threads on a surface thereof, and one end of the single core is selectively assembled with and separated from an inside electrode of a connector in a threaded manner.

The cable dielectric may be an insulator which is made of plastic resin.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
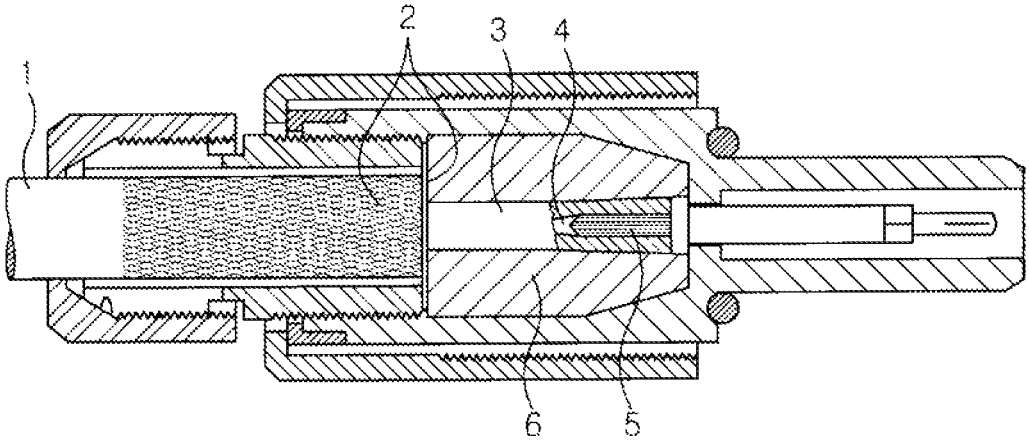
FIG. 1 is a sectional view illustrating an assembly of a connector and a cable.

Reference now should be made to the drawings, throughout which the same reference numerals are used to designate the same or similar components.

The present invention will be described in detail below with reference to the accompanying drawings. Repetitive descriptions and descriptions of known functions and constructions which have been deemed to make the gist of the present invention unnecessarily vague will be omitted below.

FIG. 1 is a sectional view illustrating an assembly of a connector and a cable.

Referring to FIG. 1, a shape of the 10 kV high-voltage connector is described as reference. The dielectric 3 of the cable which is exposed by cutting away a jacket 1 of cable and a ground metallic mesh 2 with a specific length is inserted into a connector dielectric 6.

When a cable core 4 formed of twisted pairs is coupled with the inside electrode 5 of the connector, the twisted pairs of the cable are dispersed and clamped in the grooves formed in the inside electrode 5 of the connector, and insulating glue is applied onto coupled portions.

Furthermore, in order to ensure the performance of insulation resistance against 10 kV high-voltage pulses, an insulating dielectric surrounding the inside electrode 5 of the connector is extended in the longitudinal direction thereof.

In other words, the high-voltage connector has a coupling structure specific to the cable formed of twisted pairs, and a plurality of twisted pairs which constitute the cable core 4 is coupled with the inside electrode 5 of the connector.

Figure 2:
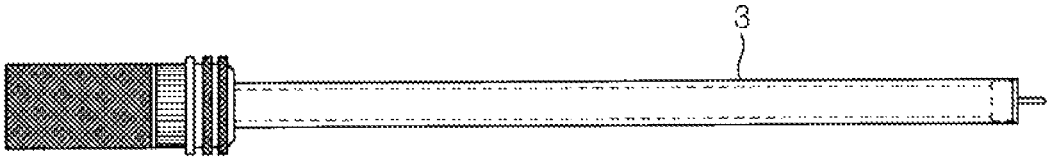
FIGS. 2 and 3 are diagrams illustrating the lengths of the inside electrode of a connector and cable dielectric of FIG. 1.
Figure 3:
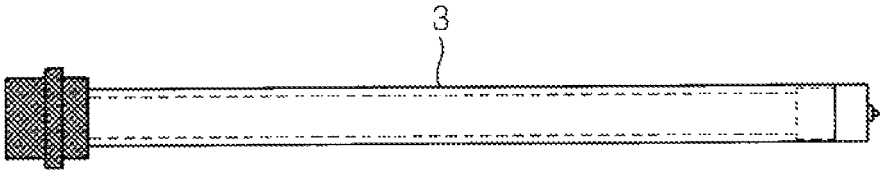

FIGS. 2 and 3 are diagrams illustrating the lengths of the inside electrode of the connector and dielectric of the cable of FIG. 1.

Referring to FIGS. 2 and 3, the head of the high-voltage connector is illustrated.

In order to improve insulation voltage performance, a dielectric and an inside electrode of a connector should be extended in a longitudinal direction. For example, in order to form a 100 kV pulse withstand voltage interface, the lengths of the inside electrode and the cable dielectric 3 are increased as 10 times longer.

When the cable dielectric 3 and the inside electrode of a connector are extended in the longitudinal direction, insulation performance is deteriorated if bending the coaxial cable for placement problem due to spatial limitation in an equipment.

Accordingly, the present invention is directed to a connector structure in which the shape of a connector dielectric and the coupling of the connector dielectric with a cable core are improved, so that pulse signals having a peak voltage equal to or higher than tens of kV, a rise time equal to or shorter than a nanosecond, a Full Width Half Maximum (FWHM) equal to or shorter than several nanoseconds, and a Pulse Repetition Frequency (PRF) equal to or lower than several kHz can be transmitted via a high voltage coaxial cable having an impedance of 50 ohm.

A connector according to an embodiment of the present invention will be described in detail below with reference to the accompanying drawings.

Figure 4:
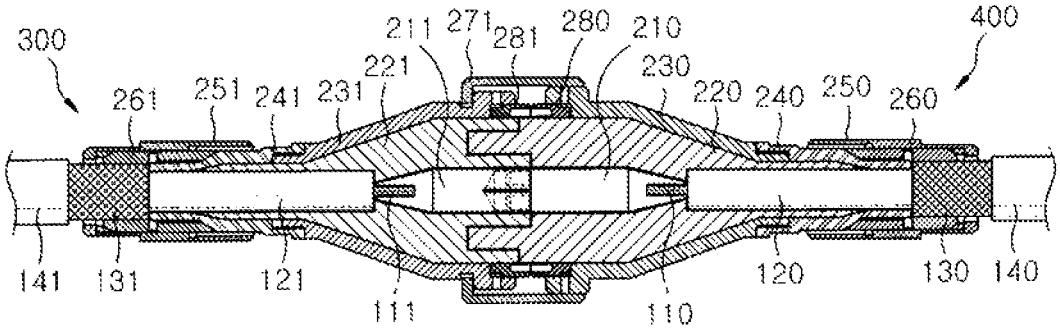
FIG. 4 is a diagram illustrating an assembly of male and female connectors according to an embodiment of the present invention.

FIG. 4 is a diagram illustrating an assembly of male and female connectors according to an embodiment of the present invention.

Referring to FIG. 4, each of male and female connectors 300 and 400 includes a single core 110 or 111, a cable dielectric 120 or 121, a cable outside conductor 130 or 131, a jacket 140 or 141, an inside electrode 210 or 211, a connector dielectric 220 or 221, and a connector housing 100 or 101.

The connector of the present invention is configured such that the male connector 400 in which one side of the connector dielectric 220 is projected is coupled with the female connector 300 in which one side of the connector dielectric 221 is depressed.

A high-voltage coaxial cable is fitted into one side of each of the male and female connectors 300 and 400, and includes the single core 110 or 111, the cable dielectric 120 or 121, and the cable outside conductor 130 or 131.

Threads are formed in the surfaces of the single cores 110 and 111, and one end of each of the single cores 110 and 111 is selectively assembled with and separated from the inside electrode 210 or 211 of the male or female connector 300 or 400 in a threaded manner.

The cable dielectrics 120 and 121 are formed along the circumferential surfaces of the single cores 110 and 111, respectively, and are insulators which are made of plastic resin.

The cable outside conductors 130 and 131 are formed along the circumferential surfaces of the cable dielectrics 120 and 121, respectively, and include ground metal which is configured in a mesh structure.

The jackets 140 and 141 are formed along the circumferential surfaces of the cable outside conductors 130 and 131, respectively.

Figure 8:
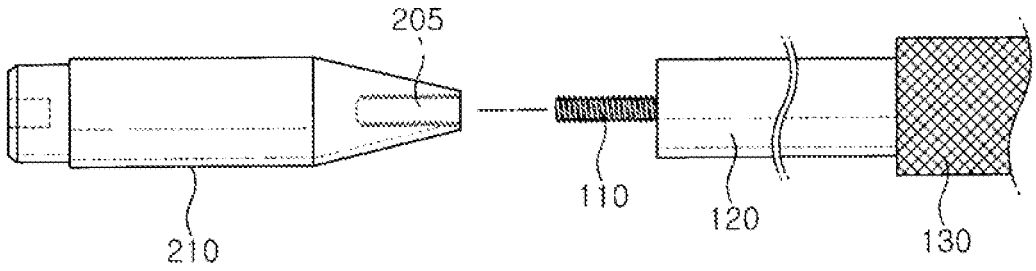
FIG. 8 is a diagram illustrating the way that the internal electrode of the connector of FIG. 5 is coupled with the high-voltage coaxial cable of FIG. 5.

A tapped hole 205 in FIG. 8 which corresponds to the threaded single core 110 or 111 is formed in one side of each of the inside electrodes 210 and 211 of a connector, and the inside electrodes 210 and 211 of a connector are selectively assembled with and separated from the high-voltage coaxial cables by using the screw action which occurs between the tapped holes 205 and the threaded single cores 110 and 111.

Furthermore, slits are formed in one end of each of the inside electrodes 210 and 211 of a connector at locations which correspond to the four ends of a cross or the two ends of a segment of a line.

The connector dielectrics 220 and 221 are formed along the circumferential surfaces of the inside electrodes 210 and 211, respectively, and coupling portions 215 and 225 which are used to engage the male and female connectors 300 and 400 with each other are formed to a preset depth in a corrugated manner.

The coupling portions 215 and 225 are formed in a depressed shape and in a projected shape, respectively, thereby engaging the male and female connectors 300 and 400 with each other.

Furthermore, the connector dielectrics 220 and 221 are insulators which are made of plastic resin.

Furthermore, as the diameter of the inside electrodes 210 and 211 of a connector increases, the diameter of the connector dielectrics 220 and 221 increases linearly.

That is, in order to maintain the high-voltage coaxial 50 ohm characteristic impedance despite the occurrence of a difference between the diameter of the single cores 110 and 111 and the diameter of the inside electrodes 210 and 211 of a connector attributable to insulating design for extension in the plane of the connector dielectrics 220 and 221, the diameters of the connector dielectrics 220 and 221 and the inside electrodes 210 and 211 of a connector increase linearly.

Each of the connector housings 100 and 101 is formed to surround the connector dielectric 220 or 221, and includes a connector ground metal member 230 or 231, a connector auxiliary coupling member 240 or 241, connector fastening members 250 and 260, or 251 and 261, and a connector attachment member 280 or 281. A head clamping member 271 is included in the connector housing 101. The head clamping member 271 may be included in the connector housing 100 or 101.

The connector ground metal members 230 and 231 are formed in a mesh structure, are coupled to the connector attachment members 280 and 281, respectively, and each surround the surface of one side of the connector dielectric 220 or 221.

The connector auxiliary coupling members 240 and 241 are coupled to the connector ground metal members 230 and 231, respectively, provide electrical connection, and each surround the surface of the other side of the connector dielectric 220 or 221.

The connector fastening members 250 and 260, or 251 and 261 are coupled to the connector auxiliary coupling member 240 or 241, surround the high-voltage coaxial cable, and are formed in the shape of a circular metal tube which fastens the high-voltage coaxial cable and the male or female connector.

The head clamping member 271 is used to clamp the male and female connectors 300 and 400.

The connector attachment members 280 and 281 are formed in the shape of rings, and support the connector dielectrics 220 and 221, respectively.

Accordingly, in order to ensure the insulting performance of the connector, the present invention is configured such that the coupling portions are corrugated to a preset depth in the direction of the front of the male and female connectors 300 and 400 and the length of the path of dielectric breakdown is designed to deal with a voltage equal to or higher than the insulating voltage of the surfaces of the dielectrics, unlike a conventional connector structure in which extension is made in a longitudinal direction.

Furthermore, when the fact that in an impedance conversion structure, the magnitude of voltage standing waves in the interval of impedance higher than 50 ohm increases is taken into consideration, the depth of corrugation may be designed such that the insulation resistance of the male and female connectors 300 and 400 is higher than that of the high-voltage coaxial cable.

Figure 5:
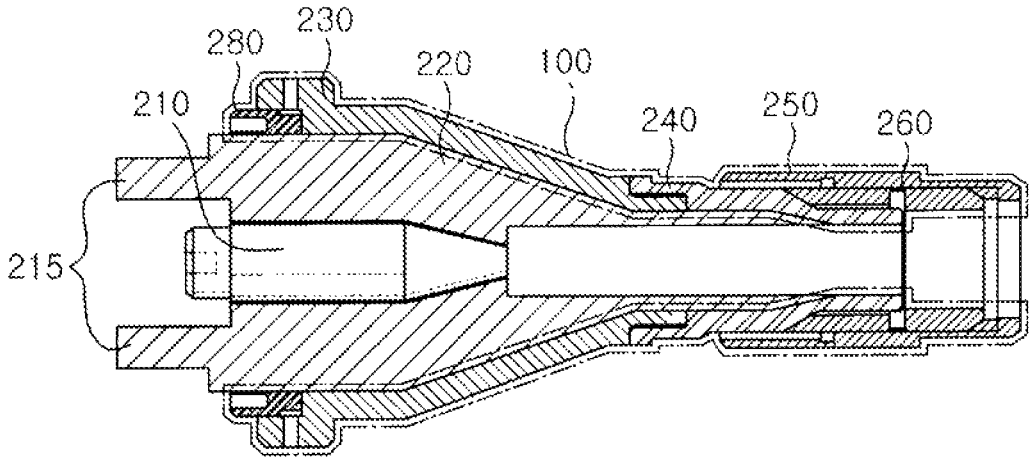
FIG. 5 is a sectional view illustrating a male connector according to an embodiment of the present invention.

FIG. 5 is a sectional view illustrating a male connector according to an embodiment of the present invention.

Referring to FIG. 5, the male connector includes a connector housing 100, an inside electrode 210 of a connector, and a connector dielectric 220.

A tapped hole 205 which corresponds to the threaded single core 110 is formed in one side of the inside electrode 210, and the inside electrode 210 is selectively assembled with and separated from the high-voltage coaxial cable by using the screw action which occurs between the tapped hole 205 and the threaded single core 110.

The connector dielectric 220 is formed along the circumferential surface of the inside electrode 210, and a coupling portion 215 which is used to engage the male and female connectors 300 and 400 with each other is formed to a preset depth in a corrugated manner.

Furthermore, a coupling portion 215 is formed in a projected shape, thereby engaging the male connector 300 with the female connector 400.

Furthermore, the connector dielectric 220 is an insulator which is made of plastic resin.

Furthermore, with respect to a structure which satisfies an insulation resistance performance equal to or higher than tens of kV, the length of the surface of the connector dielectric 220 is extended in the direction of the coupling portion 215, and therefore a difference occurs between the diameter of the internal electrode 210 of the connector and the diameter of the single core 110 of the high-voltage coaxial cable.

Here, in order to maintain a characteristic impedance of 50 ohm across the range from the high-voltage coaxial cable to the end of the connector, the following Equation 1 should be satisfied in the range where the diameter of the inside electrode 210 varies:

$$Z = \frac{138}{\sqrt{\varepsilon_r}} \log_{10}\left(\frac{D}{d}\right) \tag{1}$$

Equation 1 represents the ratio of the outside diameter D of the connector dielectric 220 to the inside diameter d of the inside electrode 210 of a male connector that are used to obtain the line impedance Z of a high-voltage coaxial cable.

$$D = d \cdot 10^{\frac{Z\sqrt{\varepsilon_r}}{138}} \tag{2}$$

Equation 2 is obtained by modifying Equation 1 in the form of the ratio of the ratio of the outside diameter D of the connector dielectric 220 to the inside diameter d of the inside electrode 210 of a male connector. In Equation 2, the outside diameter D of the connector dielectric 220 is obtained by fixing impedance Z to 50, substituting the dielectric constant $\in$ of the connector dielectric 220 into Equation 2, and linearly varying the inside diameter d in the range from the diameter of the high-voltage coaxial cable single core 120 to the inside diameter d of the internal electrode 210.

Therefore, the inside diameter of the inside electrode 210 of a connector can be determined using the calculated inside diameter d and the outside diameter D.

The connector housing 100 is formed to surround the connector dielectric 220, and includes a connector ground metal member 230, a connector auxiliary coupling member 240, connector fastening members 250 and 260, and a connector attachment member 280.

The connector ground metal member 230 is formed in a mesh structure, is coupled to the connector attachment member 280, and surrounds the surface of one side of the connector dielectric 220.

The connector auxiliary coupling member 240 is coupled to the connector ground metal member 230, provides electrical connection, and surrounds the surface of the other side of the connector dielectric 220.

The connector fastening members 250 and 260 are coupled to the connector auxiliary coupling member 240, surround the high-voltage coaxial cable, and are formed in the shape of a circular metal tube which fastens the high-voltage coaxial cable and the male or female connector.

The connector attachment member 280 is formed in the shape of a ring, and supports the connector dielectric 220.

Figure 6:
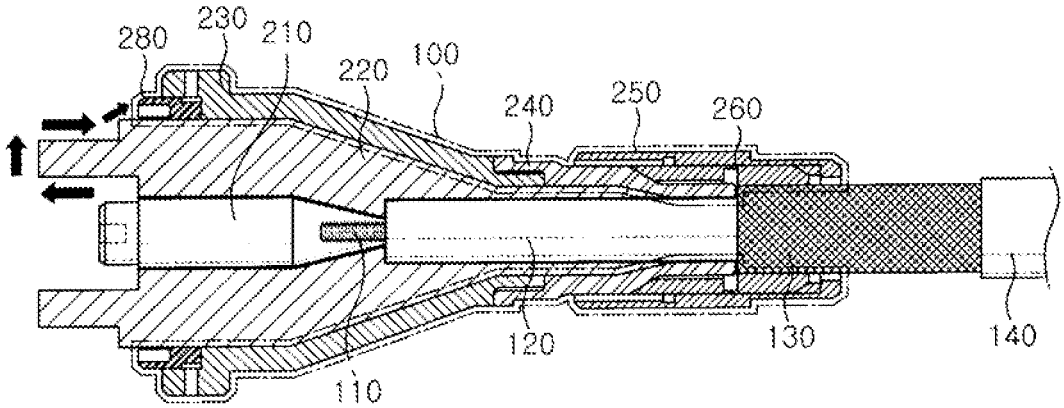
FIG. 6 is a sectional view illustrating the coupling of a high-voltage coaxial cable with the male connector of FIG. 5.

FIG. 6 is a sectional view illustrating the coupling of a high-voltage coaxial cable with the male connector of FIG. 5.

Referring to FIG. 6, the high-voltage coaxial cable which includes a single core 110, a cable dielectric 120, a cable outside conductor 130, and a jacket 140 is combined with one side of the male connector.

Threads are formed in the surface of the single core 110, and one end of the single core 110 is selectively combined with and separated from the inside electrode 210 of the male connector 300 in a threaded manner.

The cable dielectric 120 is formed along the circumferential surface of the single core 110, and is an insulator which is made of plastic resin.

The cable outside conductor 130 is formed along the circumferential surface of the cable dielectric 120, and includes ground metal which is configured in a mesh structure.

The jacket 140 is formed along the circumferential surface of the cable outside conductor 130.

Dielectric breakdown may occur in the inside of the male connector. The path of the dielectric breakdown of high-voltage pulses extends along the coupling portion 215, as indicated by the arrows in FIG. 6.

The representative paths of dielectric breakdown include a path which extends from the edge of the inside electrode 210 to the connector ground metal member 230 along the corrugated coupling portion 215, and a path which extends from the single core 110 to the ground structure along the surface of the connector dielectric 220.

Accordingly, the lengths of the corrugated coupling portions 215 and 225 of the male and female connectors form the distances of the surfaces of the dielectrics that are sufficient to provide insulation resistance for input pulses.

Figure 7:
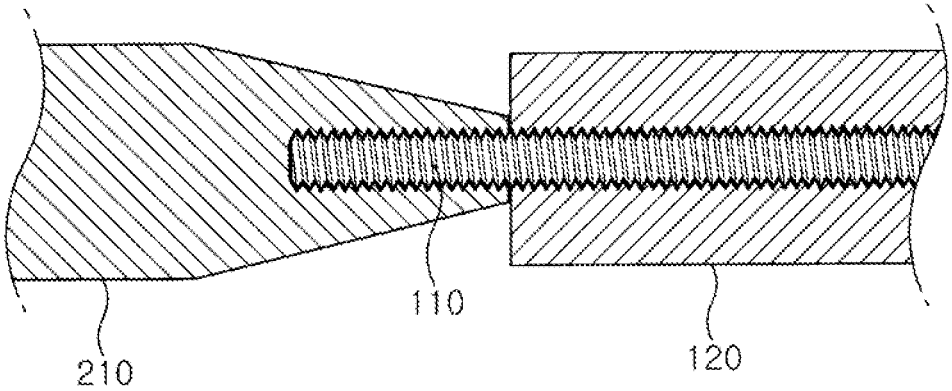
FIG. 7 is a sectional view illustrating an assembly of the internal electrode of the male connector and single core of the high-voltage coaxial cable of FIG. 5.

FIGS. 7 and 8 are diagrams illustrating the assembling of the internal electrode of the male connector of FIG. 5 to the single core of a high-voltage coaxial cable.

Referring to FIGS. 7 and 8, threads are formed in the surface of the single core 110, and one end of the single core 110 is screwed into the tapped hole 205 of the inside electrode 210 of the connector by rotating the inside electrode 210 using slits formed in one side of the inside electrode 210 so that the one end of the single core 110 can be coupled with the tapped hole 205 of the inside electrode 210.

When the high-voltage coaxial cable or the connector needs to be replaced, the one end of the single core 110 and the tapped hole 205 of the inside electrode 210 are separated from each other by rotating the inside electrode 210 in a counterclockwise direction. The high-voltage coaxial cable or the connector may be replaced many times as long as the threads of the single core 110 and the tapped hole 205 are not damaged.

Figure 9:
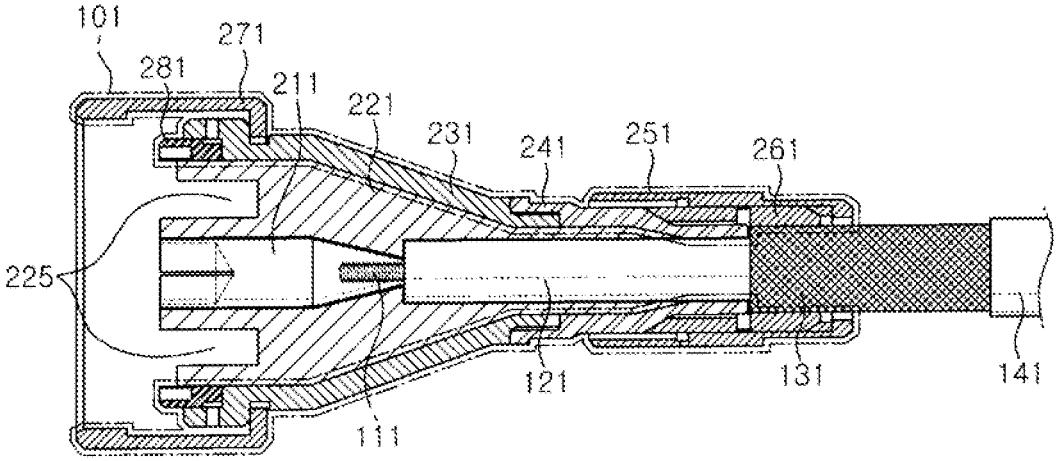
FIG. 9 is a sectional view illustrating a female connector according to an embodiment of the present invention.

FIG. 9 is a sectional view illustrating a female connector according to an embodiment of the present invention.

Referring to FIG. 9, the female connector includes a connector housing 101, a single core 111, a cable dielectric 121, a cable outside conductor 131, a jacket 141, an inside electrode 211 of a connector, a connector dielectric 221, a connector ground metal member 231, a connector auxiliary coupling member 241, connector fastening members 251 and 261, a head clamping member 271, and a connector attachment member 281.

Since the female connection of FIG. 9 is similar to the male connector of FIG. 5, redundant descriptions will be omitted here.

The coupling portion 225 of the connector dielectric 221 is formed in a depressed shape in a corrugated manner, and is fitted over the corresponding portion of the male connector 400.

The head clamping member 271 is configured to clamp the male and female connectors.

Figure 10:
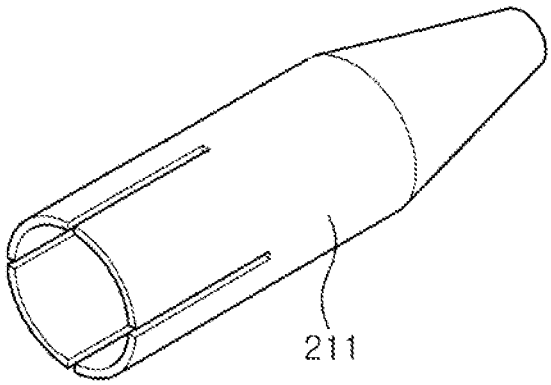
FIG. 10 is a perspective view illustrating the internal electrode of the female connector of FIG. 9.

FIG. 10 is a perspective view illustrating the internal electrode of the female connector of FIG. 9.

Referring to FIG. 10, the internal electrode 211 of the female connector is configured to be able to increase a combining force using an elastic force which is generated because the slits of the internal electrode 211 are widened when the internal electrode 211 is combined with the male inside electrode 210.

Figure 11:
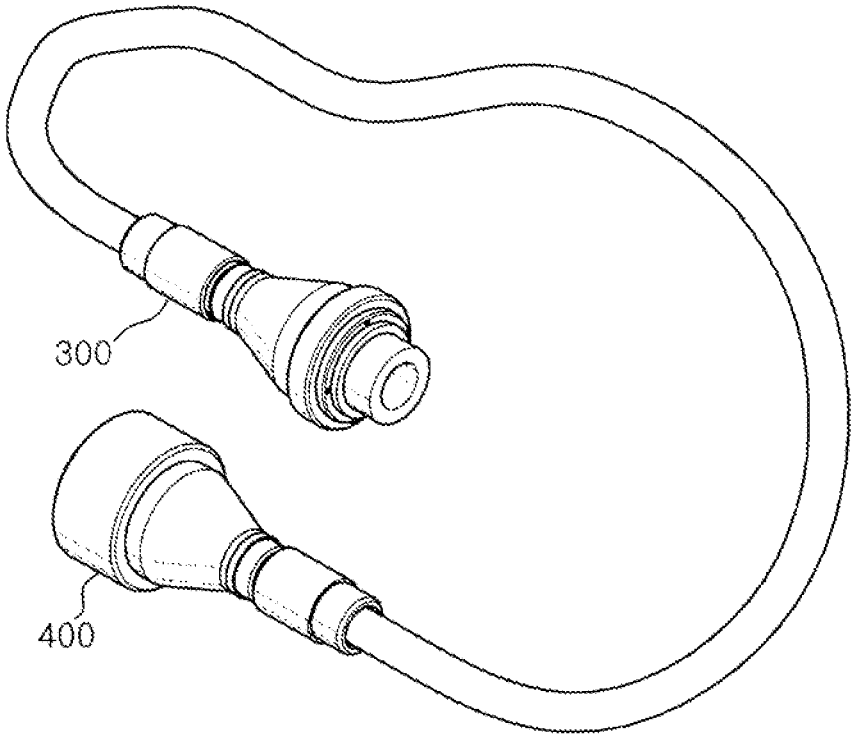
FIG. 11 is a perspective view illustrating the assembling of male and female connectors at each ends of high voltage coaxial cable according to an embodiment of the present invention.

FIG. 11 is a perspective view illustrating the assembling of male and female connectors 300 and 400 with a high voltage coaxial cable according to an embodiment of the present invention.

Referring to FIG. 11, the appearances of the female connector 300 and the male connector 400, which are used in a several tens of kV environment, are shown to illustrate the assembling thereof.

Figure 12:
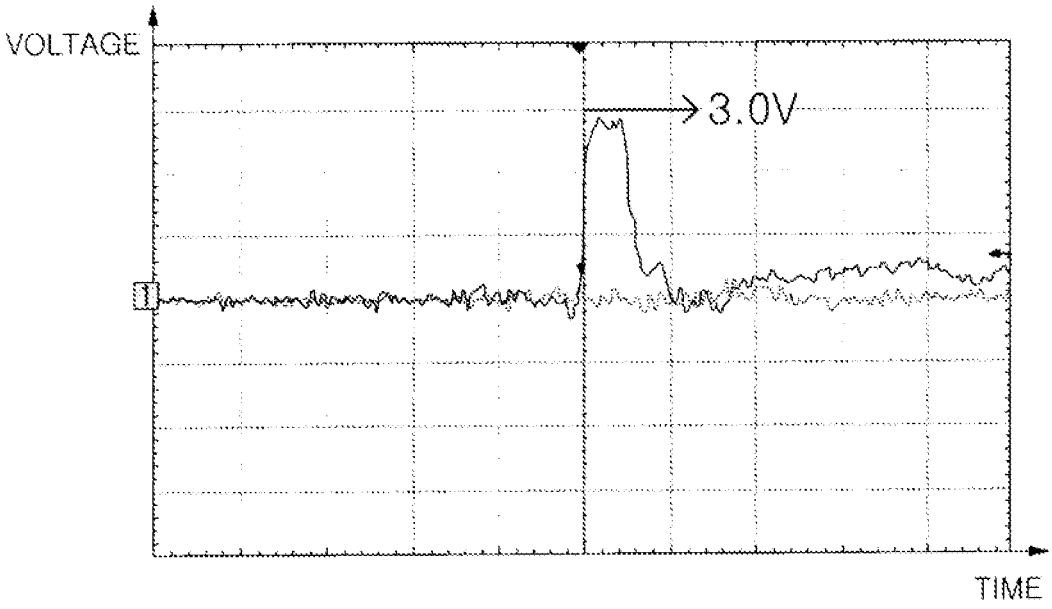
FIGS. 12 and 13 are graphs illustrating the waveforms of pulse signals that are transmitted via a high-voltage coaxial cable according to an embodiment of the present invention.
Figure 13:
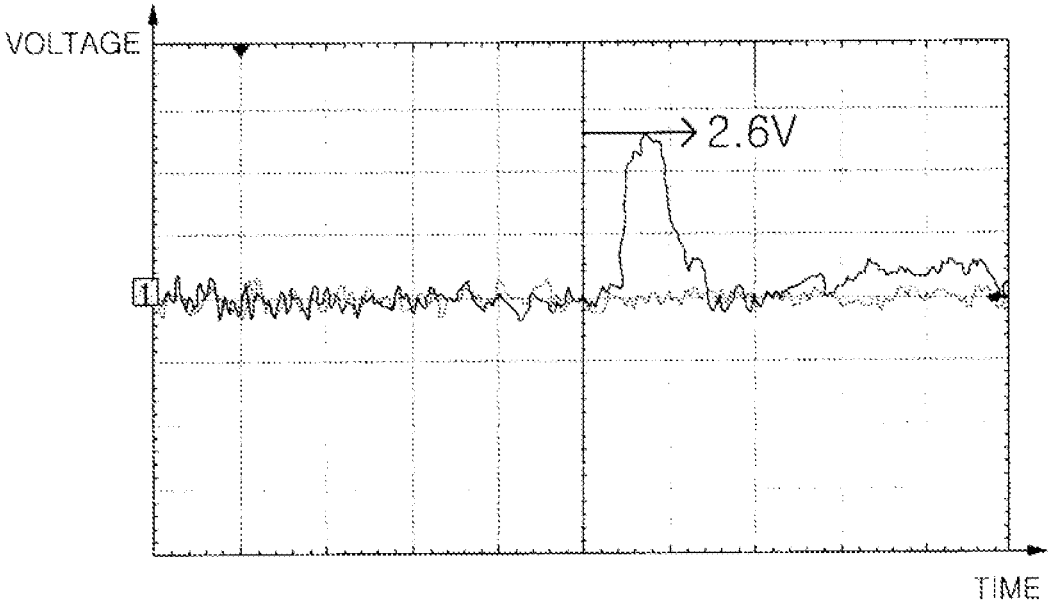

FIGS. 12 and 13 are graphs illustrating the waveforms of pulse signals that are transmitted via a high-voltage coaxial cable according to an embodiment of the present invention.

Referring to FIGS. 12 and 13, the insertion loss of a high-voltage coaxial cable for pulse output having an output voltage of 90 kV and a rise time of 300 ps is plotted using voltage waveforms.

Here, in a test arrangement, a separate pulse divider is provided, and a pulse voltage division ratio corresponding to 30 kV for 1 V is provided so that a high-voltage pulse signal of tens of kV can be testable.

In the state of terminating at a high-voltage coaxial 50 ohm load, at the output port of a measuring device, the waveform of voltage output is 3 V before the insertion of the high-voltage coaxial cable and connectors, and the waveform of voltage output is 2.6 V after the insertion of the high-voltage coaxial cable and connectors according to an embodiment of the present invention.

This means that the insertion loss of the high-voltage coaxial cable and connectors are 0.83 dB/m. Furthermore, it means reflection loss due to an impedance mismatch at the interface between the connector and transition area from connector to cable core is negligible considering a loss of the high-voltage coaxial cable by itself.

Accordingly, the present invention is configured to provide an insulating structure in the direction of the contact surface between connectors so that flexibility can be ensured for the wiring of the high-voltage coaxial cable and the placement of the connector, and is also configured to allow the single core of the high-voltage coaxial cable to be coupled with the inside electrode of the connector in a threaded manner so that the property of coupling and the performance of the electrical contact can be prevented from being deteriorated even when the core of the high-voltage coaxial cable is repeatedly assembled with and separated from the inside electrode of the connector.

The present invention is advantageous in that with regard to high-voltage pulse input, the distance of the surface of the dielectric to the inside electrode of a connector and the outside ground conductor is extended by corrugating the surface of one side of the dielectric which is coupled with another connector, and is also advantageous in that the shape of the connector dielectric can be maintained without changing an outer diameter.

Furthermore, the present invention is advantageous in that the separation and coupling of the high-voltage coaxial cable from and with the connector, which may be frequently performed due to a damage in a high voltage test, and can be facilitated because the inside electrode of a connector is coupled to the single core in a threaded manner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A connector comprising:

an inside electrode provided with a tapped hole in one side thereof, the tapped hole corresponding to a threaded single core of a high-voltage coaxial cable, the inside electrode being selectively assembled with and separated from the high-voltage coaxial cable by selectively screwing the threaded single core into and away from the tapped hole;

a connector dielectric formed along a circumferential surface of the inside electrode, and provided with an coupling portion, the coupling portion being adapted to couple the connector with another connector and being formed to a preset depth in a corrugated shape; and a connector housing formed in a shape that surrounds the connector dielectric, wherein the connector housing comprises:

a connector attachment member formed in a ring shape and adapted to support the connector dielectric;

a connector ground metal member coupled to the connector attachment member and adapted to surround a surface of one side of the connector dielectric;

a connector auxiliary coupling member coupled to the connector around metal member, and adapted to provide electrical contact and surround a surface of a remaining side of the connector dielectric; and a connector fastening member coupled to the connector coupling member, and adapted to surround and fasten the high-voltage coaxial cable.

2. The connector as set forth in claim 1, wherein the inside electrode of the connector is provided with two or four slits in another side thereof, the two or four slits being arranged at regular intervals at an end portion of the other side thereof.

3. The connector as set forth in claim 1, wherein the connector dielectric is an insulator which is made of plastic resin.

4. The connector as set forth in claim 1, wherein a diameter of the connector dielectric increases linearly as a diameter of the inside electrode increases.

5. The connector as set forth in claim 1, wherein the coupling portion is formed in a corrugated shape, and is adapted to couple the connector with the other connector.

6. The connector as set forth in claim 5, wherein the coupling portion is formed in a projected, corrugated shape, and is adapted to couple the connector with the other connector.

* * * * *